US006823649B1

(12) United States Patent
Pauchet

(10) Patent No.: US 6,823,649 B1
(45) Date of Patent: Nov. 30, 2004

(54) METHOD FOR ENCAPSULATING A TOPICAL COMPOSITION

(75) Inventor: Bernard Pauchet, Saint Capraise de Lalinde (FR)

(73) Assignee: Taiki Corporation, Ltd., Osaka (JP)

( * ) Notice: Subject to any disclaimer, the term of this patent is extended or adjusted under 35 U.S.C. 154(b) by 0 days.

(21) Appl. No.: 10/129,974

(22) PCT Filed: Nov. 22, 2000

(86) PCT No.: PCT/FR00/03246

§ 371 (c)(1),
(2), (4) Date: Jul. 24, 2002

(87) PCT Pub. No.: WO01/38174

PCT Pub. Date: May 31, 2001

(30) Foreign Application Priority Data

Nov. 23, 1999 (FR) ..... 99 14729

(51) Int. Cl.[7] ..... B65B 61/18; B65B 9/04

(52) U.S. Cl. ..... 53/412; 53/452; 53/453; 53/456; 53/454; 53/133.8

(58) Field of Search ..... 53/412, 452, 453, 53/456, 128.1, 553, 450, 454, 559, 560, 561, 133.8, 133.3

(56) References Cited

U.S. PATENT DOCUMENTS

| | | | | |
|---|---|---|---|---|
| 3,196,478 A | | 7/1965 | Baymiller et al. | |
| 3,334,374 A | | 8/1967 | Watkins, Jr. | |
| 4,430,013 A | * | 2/1984 | Kaufman | 401/132 |
| 4,611,715 A | * | 9/1986 | Redmond | 206/484 |
| 4,786,534 A | * | 11/1988 | Aiken | 428/34.2 |
| 5,161,688 A | * | 11/1992 | Muchin | 206/484 |
| 5,364,484 A | * | 11/1994 | Redmond | 156/250 |
| 5,494,192 A | * | 2/1996 | Redmond | 222/107 |
| 5,682,733 A | | 11/1997 | Perrone | |
| 5,875,614 A | * | 3/1999 | Youngs et al. | 53/455 |
| 6,006,916 A | * | 12/1999 | Matsos et al. | 206/581 |
| 6,007,264 A | * | 12/1999 | Koptis | 401/132 |
| 6,041,930 A | * | 3/2000 | Cockburn | 206/484 |
| 6,250,049 B1 | * | 6/2001 | Feldman et al. | 53/452 |
| 6,301,860 B1 | * | 10/2001 | Gunderman et al. | 53/410 |

FOREIGN PATENT DOCUMENTS

| | | |
|---|---|---|
| DE | 4329931 | 3/1995 |
| EP | 0 294 189 | 12/1988 |
| EP | 0 314 340 | 5/1989 |
| EP | 845411 | 6/1998 |
| FR | 2644425 | 9/1990 |
| GB | 2237258 | 5/1991 |
| WO | PCT WO 81/00196 | 2/1981 |
| WO | 97/06073 | 2/1997 |

* cited by examiner

*Primary Examiner*—Scott A. Smith
*Assistant Examiner*—Gloria Weeks
(74) *Attorney, Agent, or Firm*—Richard M. Goldberg

(57) ABSTRACT

A method of encapsulating a topical composition in a breakable capsule, includes the steps of elastically deforming at least a portion of a first deformable film that is impermeable to the composition so as to constitute at least one blister; injecting the topical composition into the blister; applying a second film that is impermeable to the composition onto the first film so as to close the blister; and sealing the second film and the first film together around the periphery of the blister, the portion of the first film being suitable for shrinking after release of the capsule so as to cause the pressure inside the capsule to be greater than atmospheric pressure. While the capsule is being made, at least one weak region is made in the blister, thus making the capsule suitable for being broken by exerting pressure on the capsule.

9 Claims, 1 Drawing Sheet

METHOD FOR ENCAPSULATING A TOPICAL COMPOSITION

BACKGROUND OF THE INVENTION

The present invention relates to a method of encapsulating a topical composition in a breakable capsule.

The intended field of application is particularly but not exclusively that of pads containing cream type cosmetic compositions.

Powder puffs have been used for a long time in cosmetics to deposit and spread face powder over the face. They are generally received in the lid of the box containing the powder, and powder is taken from the box by pressing the puff against the supply of powder.

The need has also been felt to spread liquid or semiliquid substances on the face, in particular creams for taking care of the skin, and requiring pads of a different kind, and in particular pads that are disposable. That makes it necessary to have available, independently, both the cream for spreading in a receptacle and the disposable pad for putting the cream onto the skin and for spreading it, and in some circumstances that does not present any difficulty.

In other circumstances, that are more occasional, particularly when testing samples, or when making an application in an unusual place, a pad has been devised in which the substance for spreading is adjacent to the applicator in a small container that is easy to open and that contains sufficient substance for one application.

Such single-use pads are difficult to manufacture automatically, and in particular it is difficult to make the capsule that forms the small container.

BRIEF SUMMARY OF THE INVENTION

An object of the present invention is to provide a method of producing capsules containing the composition for spreading, which capsules are easy to open.

Another object of the present invention is to propose applying the capsule production method to making single-use pads containing the composition for spreading.

These objects are achieved by a method of encapsulating a topical composition in a breakable capsule constituted by at least a first deformable film that is impermeable to said composition, the method comprising the following steps: a first step in which at least a portion of said first film is deformed elastically so as to constitute at least one blister; a second step in which said topical composition is injected into said blister; a third step in which a second film that is impermeable to said composition is applied onto said first film so as to close said blister; and a fourth step in which said second film and said first film are sealed together around the periphery of said blister, said portion of said first film being suitable for shrinking after release of said capsule so as to cause the pressure inside the capsule to be greater than atmospheric pressure; and while said capsule is being made, at least one weak region is made at least in said blister, thus making the capsule suitable for being broken by exerting pressure on said capsule.

The sequence of steps in making the capsule enable an automatic method to be applied to producing a capsule whose mechanical properties are well adapted to the problem of opening said capsule, with opening being performed merely by applying pressure between two fingers, while production costs are kept down to an acceptable level.

It will be understood that the method consists in a first step in making a cavity in an elastically deformable film which would normally be plane, with the topical composition for spreading on the skin then being introduced into the cavity.

The cavity is held in shape during the steps of filling, applying the second film, and sealing. Thus, when the capsule is released, the first film retains substantially the shape it has been given since the hermetically closed capsule contains said composition. However, given the elasticity of the film, on being released, i.e. when the capsule is released, it applies pressure on said composition. Thus, the pressure which acts on the composition is equal to atmospheric pressure plus the pressure induced by the elasticity of the film.

The system for opening the capsule is provided by local weakening of the film that constitutes the blister. Thus, pressure exerted on the capsule increases internal pressure, causing said capsule to be pierced in its weak region, thereby releasing the topical composition. It will be understood that the pressure to be exerted on said capsule becomes all the more effective in releasing the composition contained therein with increasing pressure inside the capsule as induced by the film.

According to another feature of the method, said portion of the first film constituting said blister is subjected to deformation that is both plastic and elastic such that said first film shrinks in part after said capsule has been released, whereby the pressure inside the capsule is not less than atmospheric pressure.

It is not easy to obtain deformation that is purely elastic leading to optimum pressure inside the capsule, and as a general rule the deformation obtained is accompanied by structural modification to the film giving rise to a fraction of deformation that is irreversible, i.e. so-called "plastic" deformation. Under such circumstances, the pressure inside the capsule is clearly smaller.

In a preferred implementation of the invention, when the two films are assembled together around the outline of said blister, the sealing includes a fraction of reduced width to constitute a weak region.

Thus, when the capsule is squeezed, opening takes place through the weak region of the sealing, at the interface between the two films.

Advantageously, a fraction of said portion of said first film constituting the blister is transformed locally so as to constitute a weak region.

The particular feature of this implementation lies in the fact that the capsule is opened through a face of said first film, and not via its interface with the second film. In this configuration, it is possible to eject the topical composition from the center of the capsule and not necessarily from the peripheral seal of said capsule.

Finally, in order to weaken the film locally, it is possible to flatten the film or to deform it, or else to melt the film locally by means of a heater or an ultrasound device.

In another preferred implementation, suction is established between a portion of the deformable first film and a recess so as to apply said film portion against the inside wall of said recess so as to constitute said blister.

It will be understood that the fact of placing the film over a cavity constituting a recess and of establishing suction between said film and said cavity tends to press the film against the inside wall of said cavity. Naturally, this wall has orifices enabling air to be sucked out.

In another preferred implementation, said first film and said second film are sealed together by means of an ultrasound device.

This implementation presents the advantage of melting only those portions of the film that are in contact, and of not including any heat source that might damage the capsule or its content.

Advantageously, the encapsulation method of the invention is applied to making pads. For this purpose, at least a first sheet of foam is applied and secured to the outside wall of said first film in order to constitute the pads.

A layer of foam is applied to the capsule made in accordance with the invention for the purpose of spreading said composition on the skin. The foam is secured to the capsule via the edges of the two films that are sealed together.

In order to make both faces of the pad agreeable to the touch, it is preferable to apply a second sheet of foam and/or of textile material on the outer wall of said second film.

In order to protect at least the face that includes the applicator foam, a protective film constituting a membrane is advantageously applied to said first sheet of foam.

BRIEF DESCRIPTION OF THE SEVERAL VIEWS OF THE DRAWINGS

Other features and advantages of the invention will appear on reading the following description given by way of non-limiting indication and with reference to the accompanying drawing, in which.

DETAILED DESCRIPTION OF THE INVENTION

Figure 1:
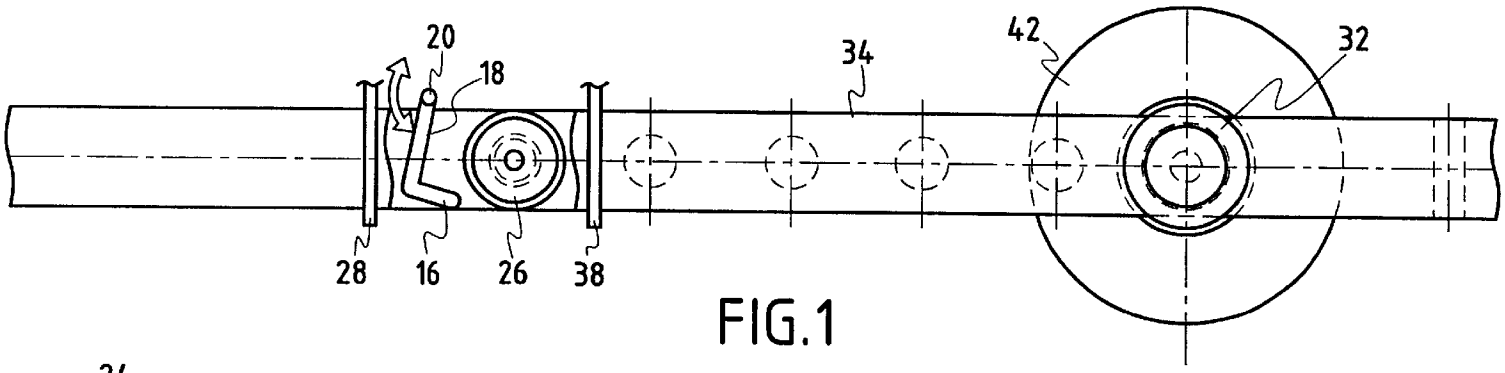
FIG. 1 is a highly diagrammatic plan view of an installation for continuously encapsulating and making pads.

The method of making a capsule containing a topical composition is described below with reference to FIGS. 1 and 2.

A first film 2 wound on a reel 4 is suitable for being unwound in the direction of an arrow F through an installation for making capsules 6. The film 2 is moved sequentially in the direction of arrow F, with the sequences corresponding to the time required for making the capsule 6.

In a first step, while the film 2 is stationary a vacuum pump 8 is activated so as to suck the film 2 into a cavity 10 constituted by a recess. The cavity 10 has orifices pierced through its wall for passing air so that the film 2 is pressed against said wall.

The plastics material film is relatively elastic, and under the effect of the suction, it tends to deform so as to take up the shape of the recess without any creasing appearing around the periphery of the blister 14 formed by the sucked-in portion of the film 2.

The film 2 can be made of polyethylene or of polyether, or it could alternately be of polyurethane which has the advantage of being highly elastic compared with other types of film.

During a second step of the method, while suction is maintained on the film 2, and consequently while the resulting blister 14 is held in shape, a topical composition is injected into said blister 14 by means of a filler spout 16.

The spout 16 is constituted by a bent tube 18 pivoted at one end by a rotary coupling 20 so as to be capable of being retracted between successive steps of filling said blisters 14. Upstream from the spout, there is a piston metering pump that dips into a tank storing the topical composition. The pump is actuated when the end of the spout 16 is vertically over the blister constituted by the portion of film 2.

Once the blister 14 has been filled by injecting a measured quantity of substance that is substantially equal to the volume of the cavity 10, the spout 16 is pivoted away by means of the coupling 20 so as to be spaced apart from the blister.

Together with the film 2, a second film 22 superposed over the film 2 is suitable for being moved along arrow F. The width of the film 22 is substantially equal to that of the film 2 and the film 22 is wound on a reel 24. Up to the cavity 10, and thus up to the blister formed in a portion of the film, these two films are sufficiently far apart to enable the filler spout 16 to be inserted between them.

During a third step, the film 22 is applied to said portion of the film 2 so as to cover and close the blister 14 containing the topical composition.

This third step is performed simultaneously with a fourth step in which the two films 2 and 22 are sealed together by means of an ultrasound device 26. The device is driven vertically along arrow D and is pressed against the two films 2 and 22 around the periphery of the cavity 10 on the edges of the recess. The two films 2 and 22 are pressed together between two substantially circular metal elements all around the periphery of the blister, and they are subjected to the effect of ultrasound type vibration (i.e. at a frequency greater than 20 kilohertz (kHz)) imparted to the two films 2 and 22 by these two metal elements. The films become bonded together by local melting.

In a particular implementation, the capsule 6 has a region of weakness in the seal between the two films 2 and 22 to enable the capsule to be opened.

To make this region, the vibrating metal elements are pressed into contact with the periphery of the blister and the two films 2 and 22 are heated between them. In at least one fraction of their contacting portions, said metal elements are narrower than around the remainder of the periphery of the blister. Thus, the width of the seal in at least said fraction is itself narrower than the width of the seal around the remainder of the blister, thereby constituting a weak region.

In use, the capsule is squeezed so as to break said weak region and release the topical composition.

In another particular implementation, the capsule presents a weak region over a fraction of said film that constitutes the blister. For this purpose, provision is made to transform a localized fraction of the film by deforming it or flattening it. These operations are performed by means of a device that is not shown but that is situated upstream from the device for forming the capsule.

The two films can also be sealed together by means of so-called "high frequency" techniques which present the advantage, like ultrasound techniques, of not heating the environment in which they are used. The films used for encapsulating the topical composition are relatively fragile, and a device of the hot iron type would tend to heat a larger area of the film excessively and would also run the risk of damaging the topical composition contained in the capsule.

Naturally the material used for making the films 2 and 22 is thermoplastic, since otherwise heat sealing would not be possible.

Once the time required for sealing has been achieved, the device 26 is raised vertically along arrow R so as to release the two films 2 and 22 as sealed together in this way. The capsule containing the topical composition is thus hermetically closed.

The operation of the vacuum pump can then be interrupted so as to release the capsule from the cavity 10 in which it is to be found. When the capsule is released, the film 2, which presents elastic properties, retracts and exerts a certain amount of pressure on the topical composition, thus tending to make it easier to release the composition when the capsule is opened.

Depending on the nature of the film, this deformation is elastic to a greater or lesser extent. The greater the extent to which the deformation is elastic, the higher the internal pressure inside the capsule, thereby causing the topical composition to be released more quickly and more fully.

In order to release the capsule from the cavity in which it is to be found, provision is made for the strip of film 22 to make a certain angle $\alpha$ with the horizontal, and consequently relative to the strip of film 2, such that when the tension in the film 22 is greater than the tension in the film 2, and when the cylinders 28 and 30 are raised to a certain extent, the capsule is released from the cavity 10.

The two films 2 and 22 can then be moved together in the direction of arrow F so as to move the previously made capsule 6 out of the way and enable a new capsule to be made. The capsules are thus connected together by the two superposed strips of film 2 and 22.

The films thus advance sequentially, and the capsules are made in such a manner that the distance between them is sufficient to enable the subsequent operations of forming the pad to be performed.

Figure 2:
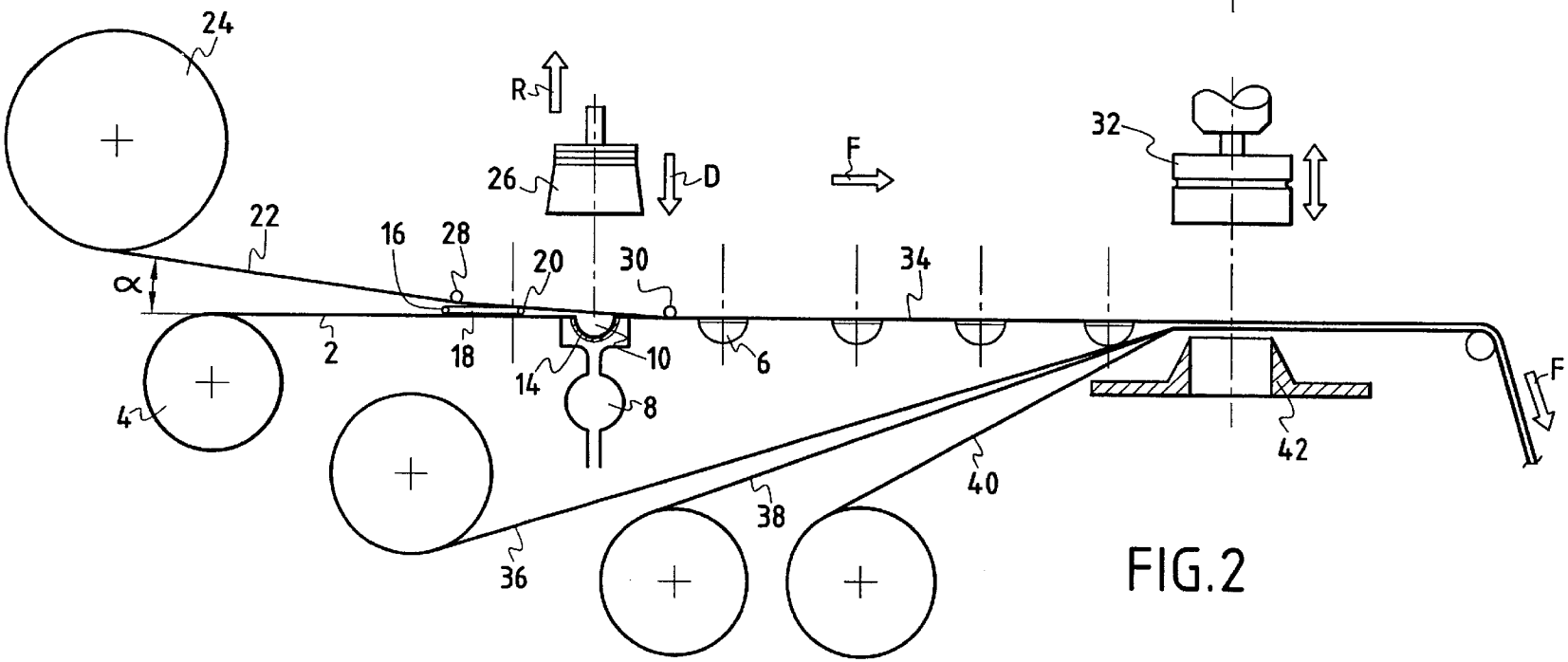
FIG. 2 is a diagrammatic longitudinal section view through the installation for continuously encapsulating and making pads.

In the embodiments shown in FIGS. 1 and 2, the installation also includes peripheral equipment for making a pad.

A punch 32 is situated over the strip of capsules 34 at a distance from the cavity in which the blisters are formed that is a multiple of the inter-capsule spacing. This disposition enables a pad to be formed during the time required to make a capsule.

The outside wall of the blister 14 constituted by the capsule 6 has simultaneously applied thereto: padding foam 36; applicator foam 38; and a protective membrane 40. Like the films 2 and 22, the foams 36 and 38, and the membrane are applied as continuous strips during the continuous process of encapsulation and pad provision.

While the capsule is received in the bottom portion 42 of the punch, the padding and applicator foams and the film constituting the membrane are pressed against the outside wall of the blister constituting the capsule. Thereafter, the top portion of the punch 32 is pressed and forced against the bottom portion 42 so as to cut out the set of elements constituting the pad in the desired shape.

The punch 32 includes a device serving, simultaneously with the cutting-out operation, to seal together the edges of the various layers so that the pad does not have an edge that might hurt the user.

What is claimed is:

1. A method of encapsulating a topical composition in a breakable capsule constituted by at least a first deformable film that is impermeable to said composition, the method comprising the steps of:

a first step comprising deforming at least a portion of said first film elastically so as to constitute at least one blister;

a second step comprising injecting said topical composition into said blister;

a third step comprising applying a second film that is impermeable to said composition onto said first film so as to close said blister; and a fourth step comprising sealing together said second film and said first film around the periphery of said blister, said portion of said first film being suitable for shrinking after release of said capsule so as to cause the pressure inside the capsule to be greater than atmospheric pressure;

wherein, while said capsule is being made, making at least one weak region at least in said blister, thus making the capsule suitable for being broken by exerting pressure on said capsule.

2. A method according to claim 1, wherein said portion of the first film constituting said blister is subjected to deformation that is both plastic and elastic such that said first film shrinks in part after said capsule has been released, whereby the pressure inside the capsule is not less than atmospheric pressure.

3. A method according to claim 1, wherein the seal includes a fraction of reduced width to constitute a weak region.

4. A method according to claim 1, wherein a fraction of said portion of said first film constituting the blister is transformed locally so as to constitute a weak region.

5. A method according to claim 1, wherein suction is established between a portion of the deformable first film and a recess so as to apply said film portion against the inside wall of said recess to as to constitute said blister.

6. A method according to claim 1, wherein said first film and said second film are sealed together by means of an ultrasound device.

7. A method according to claim 1 for making pads, wherein at least a first sheet of foam is pressed against and secured to the outside wall of said first film to constitute the pads.

8. A method according to claim 7, wherein a second foam sheet and/or textile material is applied against the outside wall of said second film.

9. A method according to claim 7, wherein a protective film is also applied to constitute a membrane on said first sheet of foam.

* * * * *